United States Patent [19]

King

[11] Patent Number: 4,587,787

[45] Date of Patent: May 13, 1986

[54] BUILDING SYSTEM

[76] Inventor: Thomas G. King, 196 Currie Road., Durban, Natal, South Africa

[21] Appl. No.: 540,052

[22] Filed: Oct. 7, 1983

[30] Foreign Application Priority Data

Oct. 8, 1982 [ZA] South Africa ..... 82/7377

[51] Int. Cl.[4] ..... E04H 12/00

[52] U.S. Cl. ..... 52/648; 52/458; 52/523

[58] Field of Search ..... 52/292, 648, 555, 539, 52/731, 733, 735, 458, 588, 519, 523, 535, 546, 591, 592

[56] References Cited

U.S. PATENT DOCUMENTS

| | | | |
|---|---|---|---|
| 2,176,778 | 10/1939 | Terrell | 52/519 X |
| 3,004,302 | 10/1961 | Nightingale | 52/523 X |
| 3,807,113 | 4/1974 | Turner | 52/539 X |

FOREIGN PATENT DOCUMENTS

| | | | |
|---|---|---|---|
| 2739320 | 3/1979 | Fed. Rep. of Germany | 52/648 |
| 150221 | 10/1931 | Switzerland | 52/539 |
| 1468190 | 3/1977 | United Kingdom | 52/648 |
| 2014686 | 8/1979 | United Kingdom | 52/648 |

*Primary Examiner*—Carl D. Friedman
*Assistant Examiner*—Naoko N. Slack
*Attorney, Agent, or Firm*—Cushman, Darby & Cushman

[57] ABSTRACT

A building system includes an assembly of vertical beams and base rails which are clad with panels. The beams are hollow section metal members having tongues at their extremities for seating in cutouts formed in the base rails. The panels for use with the beams comprise rectangular sheets which have slits for mating with overlapping panels in an edge to edge and overlapping relationship. The building system enables a structure to be readily built in modular form.

3 Claims, 5 Drawing Figures

BUILDING SYSTEM

BACKGROUND OF THE INVENTION

This invention relates to a building system and more especially to constructional elements for a building system.

The prior art is replete with various types of building systems and in a specification of this nature it is not possible to give any comprehensive review of such art.

SUMMARY OF THE INVENTION

It is an object of the invention to provide a building system which simplifies the construction of buildings.

According to the invention a constructional element includes a vertical elongated member adapted for anchorage on a base plate or a hollow body, the member including one or more formations for engagement with corresponding formations on the base plate or the hollow body and means to wedge one or more formations of the elongated member in its seating position on the base plate or the hollow body to lock the member thereto.

In a preferred form of the invention the formations on the vertical elongated member comprise projecting tongues and the corresponding formations in the base plate tube comprise grooves or bores for receiving the tongues. Preferably four projecting tongues are provided, each tongue being located at or near a corner of a square or rectangular section shaped elongated member.

The means for displacing the tongues from the seating position may comprise a wedge shaped block, a tapered screw or the like. Preferably the base plate tube is provided with a passage for directing the wedge which deforms the tongues into engagement with the base plate.

Preferably the elongated member and the base plate comprise hollow square or rectangular section beams formed from metal. The material for the beams and the cladding elements are preferably corrosion resistant.

According to another aspect of the invention there is provided a combination of the constructional element as described above together with a cladding panel adapted for joining with the cladding panels in an edge to edge relationship, the panel including a slit extending inwardly from an edge thereof for receiving a zone of an adjacent panel in an overlapping relationship, and being attachable to the constructional element.

The panels are preferably formed from sheet material having opposed edges of equal size. The material of the panel may be of a light gauge and the surface may be provided with formations for strengthening purposes.

Preferably the slit comprises a narrow cut out formed close to a corner of the panel. The length of the slit is chosen to provide a narrow zone of overlap when adjacent panels are joined.

Each panel is preferably a toothed rectangular sheet having its entire central surface pressed to simulate an assembly of bricks and mortar, the border zone being without such formations. Preferably the length of the slit corresponds with the width of the border zone so that adjacent panels may interlock only at the border zones.

BRIEF DESCRIPTION OF THE DRAWINGS

An embodiment of the invention is described by way of example with reference to the accompanying drawings in which.

DETAILED DESCRIPTION

Figure 1:
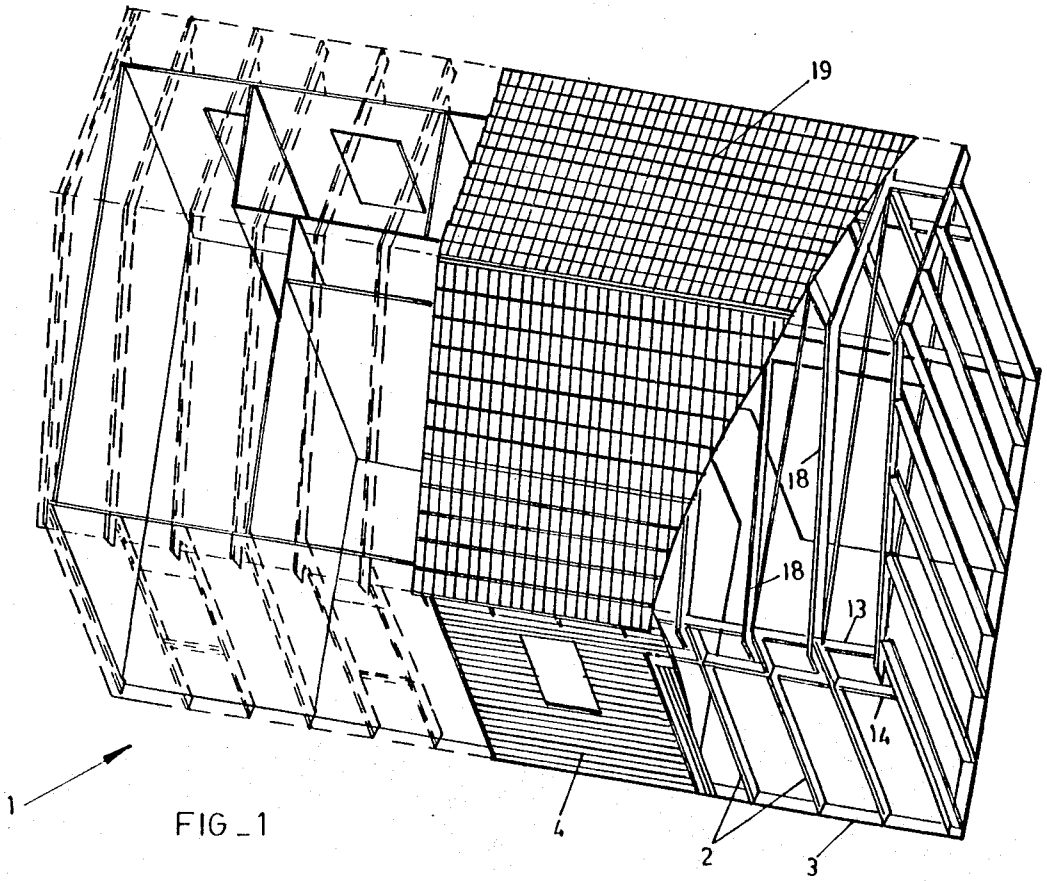
FIG. 1 is a fragmentary perspective view of a building using the constructional element and panels of the invention.
Figure 2:
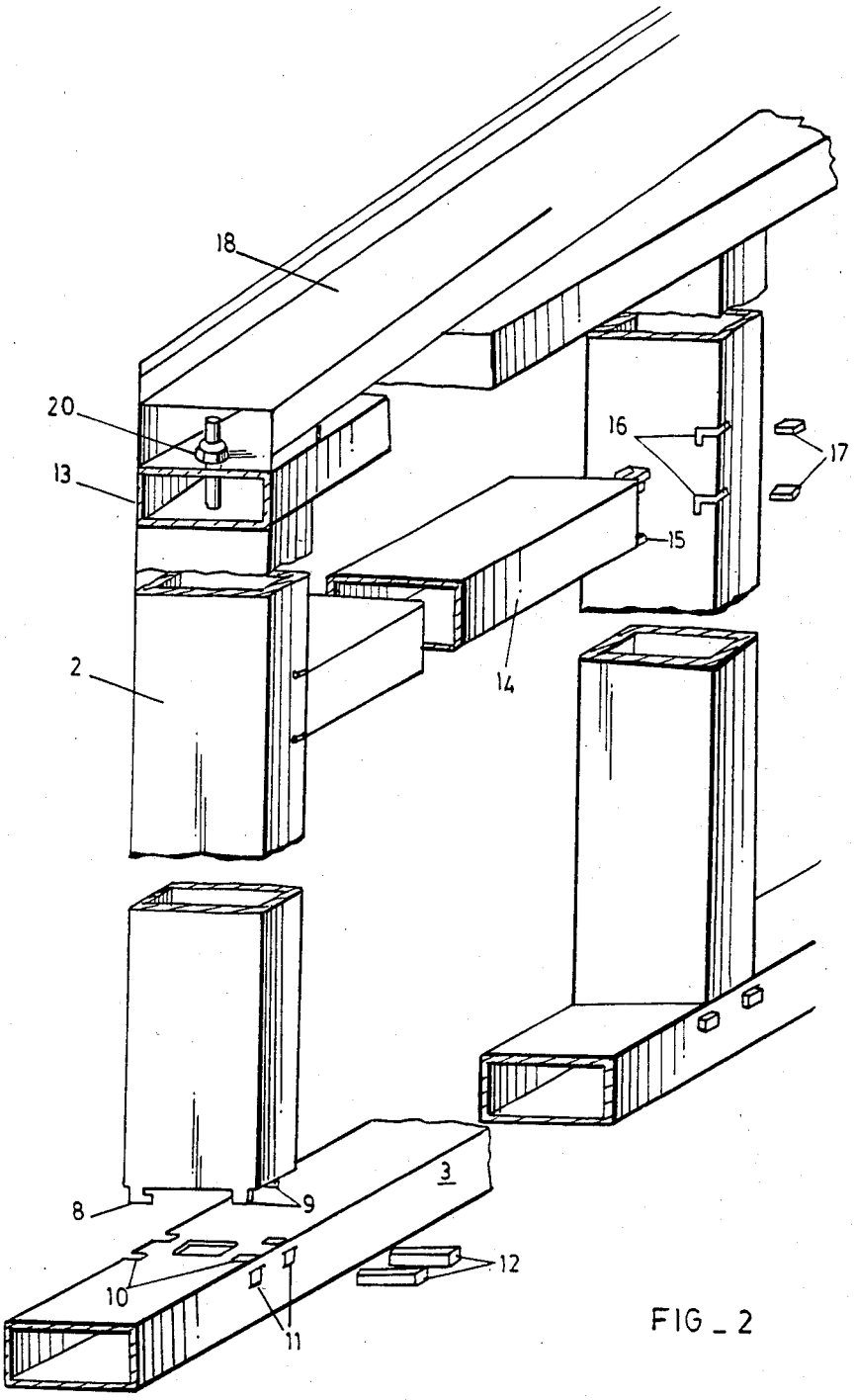
FIG. 2 is a perspective view of a constructional element according to the invention.
Figure 3:
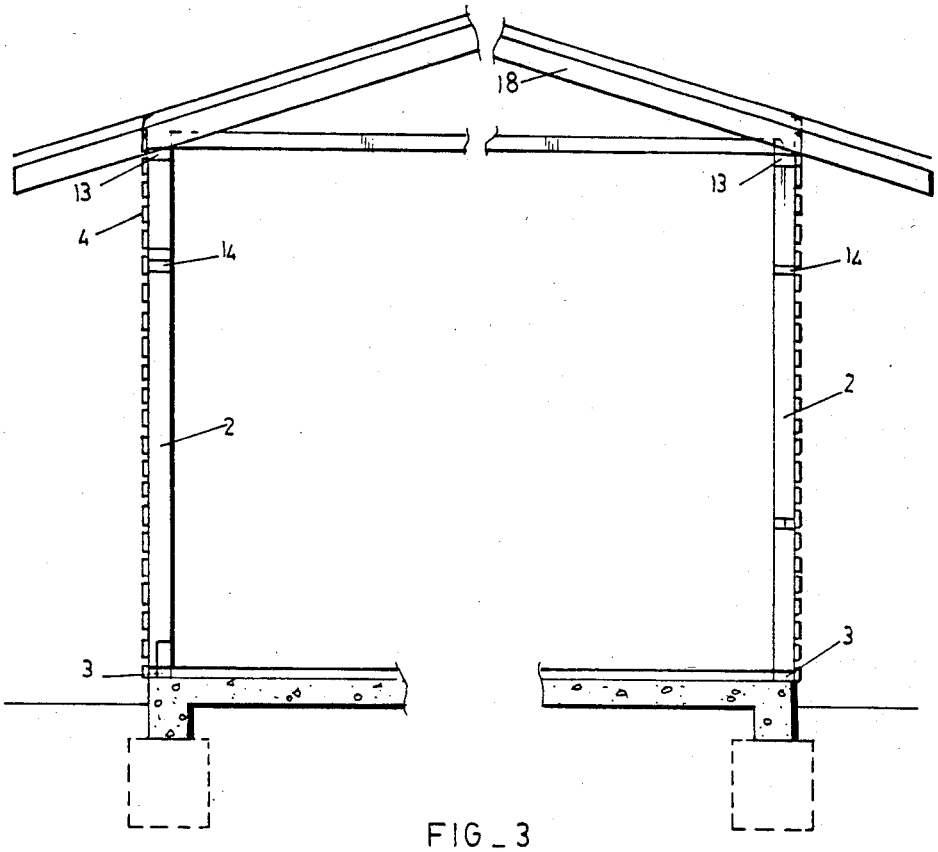
FIG. 3 is a schematic section of a building constructed according to the invention.
Figure 4:
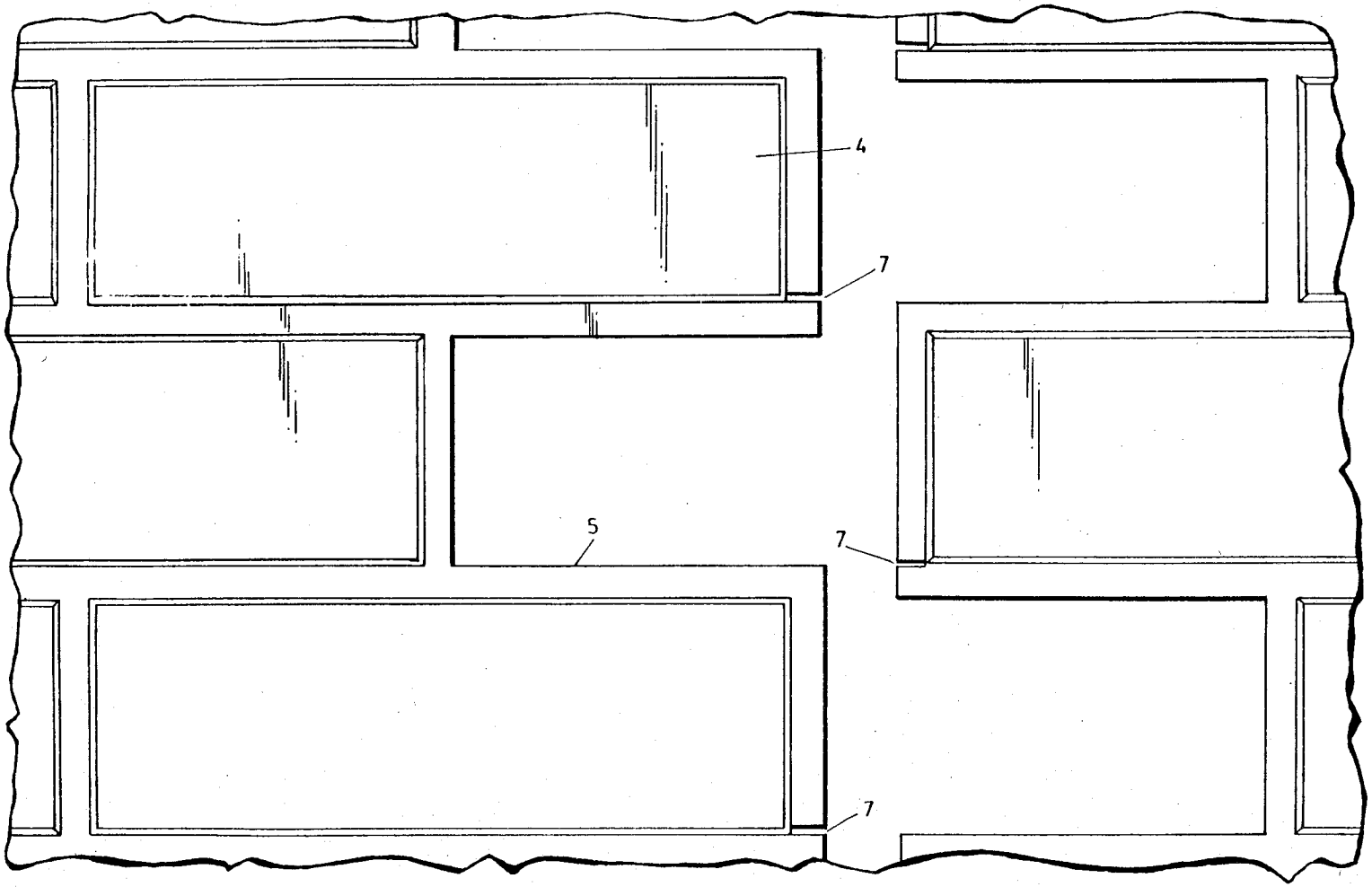
FIG. 4 is a front view of panels according to the invention.

Referring to FIGS. 1 to 4 of the drawings a building 1 includes an assembly of vertical beams 2 and base rail 3 which are clad with panels 4.

The panels 4 comprise rectangular sheets having a flat zone 5 surrounding a raised surface 6 pressed to resemble an assembly of bricks. The panels 4 are formed of light guage metal and the surface formations serve to stiffen the panels. A slit 7 extends from a short side of the toothed panel inwardly and parallel to a long side of the panel 4. During assembly of the panels 4 adjacent panels are overlapped by inserting an edge of one panel into the slit 7 of another panel. The overlapping zones are fastened to each other by means of rivets, screws or the like.

The beams 2 comprise rectangular section hollow metal beams having tongues 8,9 formed at the base (and the top if desired). As seen in the drawing the tongue 8 is joined with a right angle formation to enhance anchorage to the base rail 3 (and similarly to top rail, if desired).

The base rail 3 (and top rail) has cutouts 10 for receiving the tongues 8,9 of the beam 3. Cutouts 11 or orifices 11 are formed in register with the cutouts 10 for receiving wedges 12 or tapered elements 12 which on insertion deform the tongues 9 for locking the beam 2 to the base plate 3.

In use of the invention as seen in FIG. 1 a plurality of vertical beams 2, top rails 13, intermediate rails 14 and ground beams 3 are arranged to constitute the supporting structure for a building 1. The structure is then clad with panels externally and internal panel of plastered chicken mesh, plastic panels, timber etc. to form a hollow corresponding with the width of the beams 2,3,13,14. The hollow is filled with an infill material to provide for sound and heat insulation.

The locking of the intermediate rail 14 is achieved by means of tongues 15 which engage in slots 16 and may be displaced and secured by means of wedges 17. Metal rafter tubes 18 are provided to take metal roofing panels 19. The rafter tubes 18 are attached to the walls as shown at 20.

Figure 5:
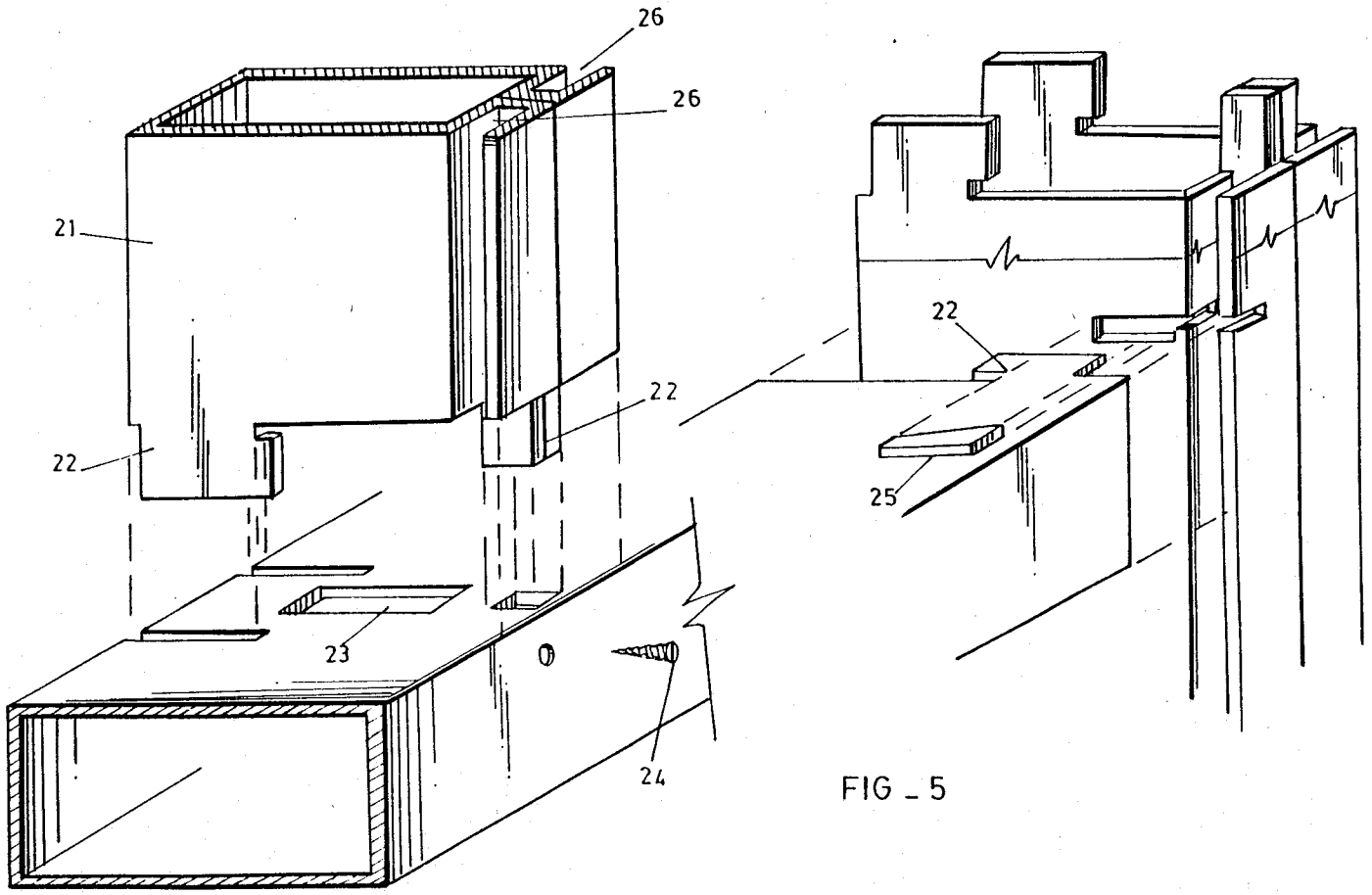
FIG. 5 is a fragmentary perspective view of another embodiment of constructional elements of the invention.

Referring to FIG. 5 a vertical beams 21 has tongues 22 for seating in corresponding grooves 23. A screw 24 is used to fasten the tongue 22 while a wedge 25 fastens the other tongue 22. The vertical beam 21 has spaced apart channel formations 26 for receiving panels and the like.

An advantage of the invention is that the building structure is in the form of modular readily assembled sections easily transportable additions may easily be constructed by connecting rails and base top rails adjacent those forming existing structure and extending the building.

I claim:

1. A building system comprising:

at least two structural elements each including a vertically elongated hollow member constructed and arranged to be anchored alternately on a base plate and a hollow body, by including at least one axial projection constructed and arranged for direct engagement with a corresponding formation on the base plate or hollow body for rigidly securing the structural element to the base plate or hollow body;

means for displacing at least one of said at least one projection on each said structural element into a seating position in which said hollow members are locked to said base plate or hollow body; and a pressed sheet metal cladding panel having an outer periphery, this panel being constructed and arranged to be joined with at least one like panel in a lapped edge-over-edge relationship, by including:

a recessed peripheral zone bordering at least one edge portion of the outer periphery of such panel, and a slit extending across said one edge portion, said slit being sized and positioned to receive a correspondingly recessed one edge portion of such like panel;

said cladding panel being constructed and arranged to be attached to at least two of said structural elements said cladding panel being rectangular;

said recessed peripheral zone extending about all of said outer periphery of the cladding panel including both side edges and both end edges thereof;

said one edge of said cladding panel being an end edge;

said slit being disposed to coincide with an imaginary linear projection of the medial margin of said peripheral zone along a respectively adjoining said side edge of said cladding panel;

said at least one projection one each said vertically elongated hollow member comprising four tongues arranged in a rectangular pattern, these tongues being constructed and arranged to be seated in four openings correspondingly formed in said base plate or hollow body; and said displacing means comprising wedge-shaped body means constructed and arranged to mount to said base plate or hollow body while wedgingly bearing against two of said four tongues.

2. The building system of claim 1, wherein:

another two of said four tongues are hooked so that each said hollow member can be locked to said base plate or hollow body by hooking said other two tongues into two of said openings in said base plate or hollow body, then inserting the first-described said two tongues into the other two of said openings and mounting said wedge-shaped body means to said base plate or hollow body in such a manner as to sufficiently bend said first-described two tongues that these two tongues are secured to and cannot be withdrawn from the base plate or hollow body.

3. The building system of claim 1, further comprising:

a horizontally elongated hollow member having at least one axial projection at each end;

at least two of said structural elements at corresponding intermediate sites thereon each including a formation constructed and arranged for securement with a said at least one axial projection at a respective end of said horizontally elongated hollow member, these formations and axial projections being non-interchangeable with those on said base plate or hollow body and vertically elongated members, respectively.

* * * * *